US006608557B1

(12) United States Patent
Menard et al.

(10) Patent No.: US 6,608,557 B1
(45) Date of Patent: Aug. 19, 2003

(54) SYSTEMS AND METHODS FOR TRANSMITTING SIGNALS TO A CENTRAL STATION

(75) Inventors: Raymond J. Menard, Hastings, MN (US); Curtis E. Quady, Burnsville, MN (US)

(73) Assignee: Royal Thoughts, LLC, Minneapolis, MN (US)

( * ) Notice: Subject to any disclaimer, the term of this patent is extended or adjusted under 35 U.S.C. 154(b) by 0 days.

(21) Appl. No.: 09/383,784

(22) Filed: Aug. 26, 1999

Related U.S. Application Data

(60) Provisional application No. 60/098,387, filed on Aug. 29, 1998.

(51) Int. Cl.[7] ..... G08B 29/00

(52) U.S. Cl. ..... 340/506; 340/3.1; 340/539; 340/825.36; 340/825.44; 340/825.49

(58) Field of Search ..... 340/506, 3.1, 539, 340/825.36, 825.44, 825.49

(56) References Cited

U.S. PATENT DOCUMENTS

| | | | | |
|---|---|---|---|---|
| 3,843,841 | A | 10/1974 | Rubinstein | 179/5 P |
| 3,969,709 | A | 7/1976 | Isaacs et al. | 340/224 |
| 4,237,344 | A | 12/1980 | Moore | 179/2 A |
| 4,284,849 | A | 8/1981 | Anderson et al. | 179/5 R |
| 4,303,801 | A | 12/1981 | Anderson et al. | 179/5 R |
| 4,531,527 | A | 7/1985 | Reinhold, Jr. et al. | 128/696 |
| 4,772,876 | A | 9/1988 | Laud | 340/539 |
| 4,843,377 | A | 6/1989 | Fuller et al. | 340/573 |
| 4,856,047 | A | 8/1989 | Saunders | 379/57 |
| 4,908,600 | A | 3/1990 | Martinez | 340/310 R |
| 4,993,059 | A | 2/1991 | Smith et al. | 379/39 |
| 4,994,787 | A | 2/1991 | Kratt et al. | 340/505 |

(List continued on next page.)

OTHER PUBLICATIONS

*Skyroute Communications*, http://www.sur–gard.com/skyroute.htm, pp. 1–4, (1974).
"21st Century Emergency Safety Communication Policy", *ComCARE Alliance*, http://www.comcare.org/21ct99.htm, 3 pages, (2000).
"AlarmNet–A Original Alarmnet", *AlarmNet*, http;//www.ademco.com/AlarmNet/AlarmNetA.htm, pp. 1–2, (2000).
"AlarmNet–C Control Channel Cellular", *AlarmNet*, http://www.ademco.com/AlarmNet/AlarmNetC.htm, 2 pages, (2000).
"AlarmNet–M Mobitex System", *AlarmNet*, http://www.ademco.com/AlarmNet/AlarmNetM.htm, p. 1, (2000).
"allNetDevices:—Geoworks, Openware End Patent Fight", *allNetDevices*, http://www.devices.internet.com/icom_cgi/print/print.cgi?url=http://devices.internet.comlindustry/ne..., 1 page, (2000).
"allNetDevices:—The Device–Centric Home in 2000: Close, But No Cigar", *allNetDevices*, http://www.devices.internet.com, 3 pages, (2000).
"Automatic Crash Notification", *ComCARE Alliance*, http://www.comcare.org/overview.htm, 2 pages, (2000).
"Connect 24 Data Communications", *Connect 24*, http://www.connect24.com, 1 page, (2001).
"Emergency 911 Cellular Phone and Cellular Phone Accessories", *AAA Communications*, http://web.idirect.com/aaa/, 1–7 pages, (2001).

(List continued on next page.)

*Primary Examiner*—Daryl Pope
(74) *Attorney, Agent, or Firm*—Schwegman, Lundberg, Woessner & Kluth, P.A.

(57) ABSTRACT

Systems, structures, and methods are provided to transmit signals from a detection system to a central station. The described embodiments use an enhanced wireless system to send a message to alert the central station of an alarm event at a premise. Such message has the ability to be sent to alternative central station if the message cannot be sent to the intended central station.

26 Claims, 4 Drawing Sheets

U.S. PATENT DOCUMENTS

| | | | | | |
|---|---|---|---|---|---|
| 5,016,172 | A | | 5/1991 | Dessertine | 364/413.02 |
| 5,025,374 | A | | 6/1991 | Roizen et al. | 364/413.02 |
| 5,062,147 | A | | 10/1991 | Pickett et al. | 364/900 |
| 5,081,667 | A | | 1/1992 | Drori et al. | 379/59 |
| 5,128,979 | A | | 7/1992 | Reich et al. | 379/40 |
| 5,223,844 | A | | 6/1993 | Mansell et al. | 342/357 |
| 5,228,449 | A | | 7/1993 | Christ et al. | 128/691 |
| 5,276,728 | A | | 1/1994 | Pagliaroli et al. | 379/58 |
| 5,278,539 | A | | 1/1994 | Lauterbach et al. | 340/539 |
| 5,319,355 | A | | 6/1994 | Russek | 340/573 |
| 5,319,698 | A | | 6/1994 | Glidewell et al. | 379/39 |
| 5,351,235 | A | | 9/1994 | Lahtinen | 370/58.1 |
| 5,390,238 | A | | 2/1995 | Kirk et al. | 379/93 |
| 5,398,782 | A | * | 3/1995 | Talbot et al. | 187/393 |
| 5,402,466 | A | | 3/1995 | Delahanty | 379/44 |
| 5,404,577 | A | | 4/1995 | Zuckerman et al. | 455/66 |
| 5,412,372 | A | | 5/1995 | Parkhurst et al. | 340/568 |
| 5,416,695 | A | | 5/1995 | Stutman et al. | 364/413.02 |
| 5,432,841 | A | | 7/1995 | Rimer | 379/59 |
| 5,451,839 | A | | 9/1995 | Rappaport et al. | 375/224 |
| 5,485,504 | A | | 1/1996 | Ohnsorge | 379/58 |
| 5,486,812 | A | | 1/1996 | Todd | 340/539 |
| 5,513,111 | A | | 4/1996 | Wortham | 364/460 |
| 5,568,535 | A | * | 10/1996 | Sheffer et al. | 379/39 |
| 5,570,083 | A | | 10/1996 | Johnson | 340/692 |
| 5,583,831 | A | | 12/1996 | Churchill et al. | 368/10 |
| 5,587,701 | A | | 12/1996 | Hess | 340/541 |
| 5,630,207 | A | | 5/1997 | Gitlin et al. | 455/54.1 |
| 5,652,564 | A | | 7/1997 | Winbush | 340/426 |
| 5,687,215 | A | | 11/1997 | Timm et al. | 379/58 |
| 5,719,551 | A | | 2/1998 | Flick | 340/426 |
| 5,736,932 | A | | 4/1998 | Bulfer et al. | 340/825.34 |
| 5,739,748 | A | | 4/1998 | Flick | 340/426 |
| 5,752,976 | A | | 5/1998 | Duffin et al. | 607/32 |
| 5,777,551 | A | | 7/1998 | Hess | 340/541 |
| 5,784,685 | A | | 7/1998 | Stanford et al. | 455/31.2 |
| 5,786,746 | A | | 7/1998 | Lombardo et al. | 340/286.07 |
| 5,793,283 | A | | 8/1998 | Davis | 340/426 |
| 5,812,536 | A | | 9/1998 | Manduely | 370/282 |
| 5,815,417 | A | | 9/1998 | Orr et al. | 364/578 |
| 5,821,854 | A | | 10/1998 | Dorinski et al. | 340/539 |
| 5,825,283 | A | | 10/1998 | Camhi | 340/438 |
| 5,845,203 | A | | 12/1998 | LaDue | 455/414 |
| 5,850,180 | A | | 12/1998 | Hess | 340/541 |
| 5,850,344 | A | | 12/1998 | Conkright | 364/479.01 |
| H1782 | H | | 2/1999 | Wicks et al. | 340/825.44 |
| 5,870,020 | A | | 2/1999 | Harrison, Jr. | 340/426 |
| 5,873,043 | A | | 2/1999 | Comer | 455/458 |
| 5,874,889 | A | | 2/1999 | Higdon et al. | 340/426 |
| 5,892,442 | A | | 4/1999 | Ozery | 340/539 |
| 5,898,391 | A | | 4/1999 | Jefferies et al. | 340/988 |
| 5,898,904 | A | | 4/1999 | Wang | 455/31.3 |
| 5,902,234 | A | | 5/1999 | Webb | 600/300 |
| 5,907,279 | A | | 5/1999 | Bruins et al. | 340/506 |
| 5,917,405 | A | | 6/1999 | Joao | 340/426 |
| 5,933,080 | A | | 8/1999 | Nojima | 340/539 |
| 5,959,529 | A | | 9/1999 | Kail, IV | 340/539 |
| 6,023,223 | A | | 2/2000 | Baxter, Jr. | 340/531 |
| 6,023,241 | A | | 2/2000 | Clapper | 342/357.13 |
| 6,028,514 | A | | 2/2000 | Lemelson et al. | 340/539 |
| 6,035,021 | A | | 3/2000 | Katz | 379/93.12 |
| 6,057,758 | A | | 5/2000 | Dempsey et al. | 340/539 |
| 6,087,952 | A | | 7/2000 | Prabhakaran | 340/693.5 |
| 6,118,866 | A | | 9/2000 | Shtivelman | 379/309 |

OTHER PUBLICATIONS

"Emergency Terms", *Glossary*, http://www.comcare.org/glossary.htm, 3 pages, (2000).

"Introduction to the HomeRF Technical Specification", *HomeRF*, pp. 1–17, (2000).

"ORA Electronics Introduces Rescue Mate, a Complete Cellular Telephone Safety Package; Hands–Free Operation, Instant Emergency 911 Access, Roadside Assistance Services", *Business Wire*, http://www.findarticles.com, 2 pages, (1998).

"PSAP Updates and Third–Party Call Centers", *ComCARE Alliance*, http://www.comcare.org/psap.htm, 2 pages, (2000).

"Samsung Electronics joins home radio frequency group in development of wireless network for the home", *Samsung Electronics*, http://www.samsung.com/news/samsung/1998/sea0305.html, pp. 1–2, (1998).

"Tachless Remote Engine Starters", *Almex*, http://www.almexltd.com/iei/mantis1200.htm, pp. 1–3, (2000).

"Will the push—not pull—of Internet information dramatically alter out Web interactions", *Sunworld*, http://www.sunworld.com, 6 pages, (2000).

"ARM7 Thumb Family", *Arm Powered*, Product Information, 4 Pages, (Prior to May 26, 200).

"ARM9 Thumb Family", *Arm Ltd.*, Product Information, 6 Pages, (Prior to May 26, 200).

"Blue–Connect", *Acer NeWeb Corporation*, Product Brief, 1 page, (Prior to May 26, 200).

"Blue–Share", *Acer NeWeb Corporation*, Product Brief, 1 page, (Prior to May 26, 200).

"Bluetooth—solutions for personal area networking", *TDK Systems, Inc.*, Manufactures Brochure, 4 pages, (Prior to May 26, 200).

"Bluetooth Development using SDL, MSC and TTCN", *Teleogic AB*, Product Information, 13 pages, (Prior to May 26, 200).

"Bluetooth Product Design—a natural progressionof our existing buiness", *RTX*, Manufactures Brochure, 4 pages, (Prior to May 26, 200).

"Bluetooth White Paper", *AU–System AB*, Entire Pamphlet, (1999).

"CreataLink", *Motorola, Inc.*, 2 pages, (1999).

"CreataLink 2XT", *Motorola Messaging Products*, www.mot.com/MIMS/MSPG/Products/OEM/calxt/, 1 p., (Mar. 1999).

"Designing Solutions for the Internet Economy", *Intel Developer Forum Spring 2000*, Program Brochure, 2 pages, (Feb. 15–17, 2000).

"Digianswer Bluetooth—Development and Demonstration Tools", *Digianswer A/S*, Product Sheet, 6 pages, (Prior to May 26, 200).

"Digianswer/Bluetooth Technology", *Digainswer (Irl) Ltd.*, Product Inforamtion, 8 Pages, (Prior to May 26, 200).

"Empowering the mobile enterprise", *Puma Technology, Inc.*, Manufactures Brochure, 2 pages, (1996–1999).

"Emulation System Speeds Development of CDMA Satcom Handsets", *Penton Publishing, inc.*, Product Information, 4 Pages, (1997).

"Enabling Innovation", *Arm Ltd.*, Product Brochure, 10 Pages, (1999).

"Get a better vantage point and outmaneuver the competition", *Cadence Design Systems, Inc.*, Manufactures Brochure, 2 pages, (1999).

"IVT—Bluetooth Protocol Stack SDL/C Source Code", *Bluthtooth*, Product Brochrue, 2 pages, (Prior to May 26, 200).

"Lucent Technologies and Bluetooth", *Lucent Technologies, Inc.*, Manufactures Brochure, 2 pages, (Dec. 1999).
"ObjectGEODE—The Most Advanced Integrated Enviornment for the Development of Distributed Real–time Systems", *Verilog S.A.*, Entire Brochure, (1998).
"OSE—the new generation realtime operating system", *ENA OSE Systems*, Informational Brochure, Entire booklet, (1999).
"Socket's Bluetooth Cordless Communications Card FAQ", *Socket Communications, Inc.*, Informational Literature, 2 pages, (Dec. 1999).
"Spontaneous Connections", *CommVerge*, 6 pages, (May 2000).
"Technology Solutions for Bluetooth from Erricsson Microelectronics", *Ericson Components AB*, Manufactures Brochure, 2 pages, (Nov. 1999).
"The Ericsson Bluetooth Developement Kit—Faster launching of Bluetooth Products", *Ericsson Mobile Communications, AB*, Manufactures Brochure, 2 pages, (1999).
"The Secret of Sucess!", *SIGnal Newsletter—The Official Newsletter of the Bluetooth Special Interest Group*, Issue No. 3, 8 Pages, (Nov. 1999).
"UMTS W–DCMA Technology Development Using the Aptix System Explorer MP4 for Algorithm Verification", *Aptix Corporation*, Prodcut Information, 4 Pages, (1999).
"Unleash the World—Core technology for Bluetooth applications", *Ericsson Mobile Communications AB*, Manufactures Brochure, 8 pages, (1999).

"Wireless Connections Made Easy", *Bluetooth*, Manufactures Brochure, 19 Pages, (Prior to May 26, 200).

"Your Vision—Our Solution", *RTX Telecom*, Manufactures Brochure, 6 pages, (Prior to May 26, 200).

Houston, J., "Socket Teams with Cambridge Silicon Radio for Bluetooth Cordless Networking on Windows CE", *Socket Communications, Inc.*, Press Release, 2 pages, (1999).

Nobel, C., "Microsoft jumps on the Bluetooth bandwagon", *PC Week*, 1 page, (Dec. 6, 1999).

"CreataLink 2XT", *Motorola Messaging Products*, www.mot.com/mims/mspg/products/oem/calxt/, 1 pg., (Mar. 99).

Posti, J., "Motorola Introduces CreataLink 2 XT ReFLEX Two–way Data Transceiver for Wireless Communications", *Motorola Press Release*, www.mot.com/MIMS/MSPG/Press/PRI9990303_21575.html, 2 p., (Mar. 1999).

* cited by examiner

400

| NUMBER OF BITS | OPTION COUNT | DESCRIPTION |
|---|---|---|
| 3 | 8 | DESTINATION CODE, FOR EXAMPLE A LIST OF OPTIONAL CENTRAL STATION AND USER DESTINATIONS IS STORED IN THE WIRELESS NETWORK. THE DESTINATION CODE TELLS THE NETWORK WHICH OPTIONAL DESTINATION SET (8 TOTAL LOOKUP SETS) TO USE FOR THIS MESSAGE. A SET MAY INCLUDE ONE OR MORE POTENTIAL DESTINATIONS. |
| 0–2 | 0–4 | BACKUP DESTINATION CODE: DESIGNATES A BACKUP DESTINATION OPTION IF THE MESSAGE IS UNDELIVERABLE TO THE PRIMARY DESTINATION. THE NETWORK STORES THE BACKUP DESTINATION. THIS INFORMATION COULD BE OPTIONALLY STORED IN THE NETWORK DESTINATION CODE LOOKUP SET DESCRIPTION. |

FIG. 4

SYSTEMS AND METHODS FOR TRANSMITTING SIGNALS TO A CENTRAL STATION

PRIORITY

This application claims the benefit under 35 U.S.C. sec. 119(e) of U.S. Provisional Application No. 60/098,387, filed Aug. 29, 1998.

TECHNICAL FIELD

The present invention relates generally to communication networks. More particularly, it pertains to communicating security signals to a central station through communication networks.

Background Information

In the security alarm industry, detection devices detect various conditions in the premise, such as a residence or an art gallery. These conditions may indicate fire, burglary, medical, environmental, or other emergency conditions that may exist. The security system then transmits the information by various means to a central response center (central station). The central station then coordinates the response activities of others back to the premise.

Generally the method used to transmit alarm signals to the central station is a modem system over a standard land-based telephone line. A land-based telephone line may present an opportunity for a thief to easily tamper with the operation of the alarm in attempting to defeat a detection system and gain access to the premise.

As a result, various wireless systems have been proposed to protect the transmission. Although these wireless systems have been used as a secondary backup, in some instances, they have been used for primary alarm transmission. However, these methods are all quite expensive and so less than an estimated 2% of detection systems currently use a wireless transmission of signals to the central station.

Thus, what is needed are systems and methods to enhance the use of wireless transmission in detection systems.

SUMMARY

The above-mentioned problems with the use of wireless transmission systems as well as other problems are addressed by the present invention and will be understood by reading and studying the following specification. Systems and methods are described which enhance the use of wireless transmission in detection systems.

One illustrative embodiment includes an exemplary system that comprises an alarm panel to provide an alarm signal. The system also comprises at least one look-up table (first look-up table) to encode the alarm signal as one of a plurality of event types into a message. The message includes a code for each event type and a destination string.

In another illustrative embodiment, the exemplary system further comprises a network to pass the message of the first look-up table. The system also comprises a second look-up table to decode the destination string of the message to determine a decoded destination of the message. The network passes the message to the decoded destination of the message.

In another illustrative embodiment, the exemplary system further comprises a central station to receive the message from the network. The system further comprises a third look-up table to decode the code of the first look-up table. The third look-up table produces a security code from the code of the first look-up table.

In another illustrative embodiment, an exemplary method comprises reading an alarm bus by a transmitter for at least one alarm signal. The method further comprises encoding the alarm signal into a message by looking up at least one table that is stored on the transmitter. The act of encoding includes encoding the alarm signal into a code representing one of the plurality of event types into the message. The act of encoding includes encoding a destination string into the message.

In another illustrative embodiment, the method further comprises decoding the destination string to determine the destination of the message. The method further comprises decoding the code representing one of the plurality of event types into a security code.

In another illustrative embodiment, an exemplary data structure is described. The data structure includes an event identifier to identify an occurrence of an alarm event, and an event descriptor to describe the alarm event in at least one detail.

These and other embodiments, aspects, advantages, and features of the present invention will be set forth in part in the description which follows, and in part will become apparent to those skilled in the art by reference to the following description of the invention and drawings or by practice of the invention.

BRIEF DESCRIPTION OF THE DRAWINGS

FIG. 4 is a table illustrating a destination string in accordance with one embodiment.

DETAILED DESCRIPTION

Figure 1:
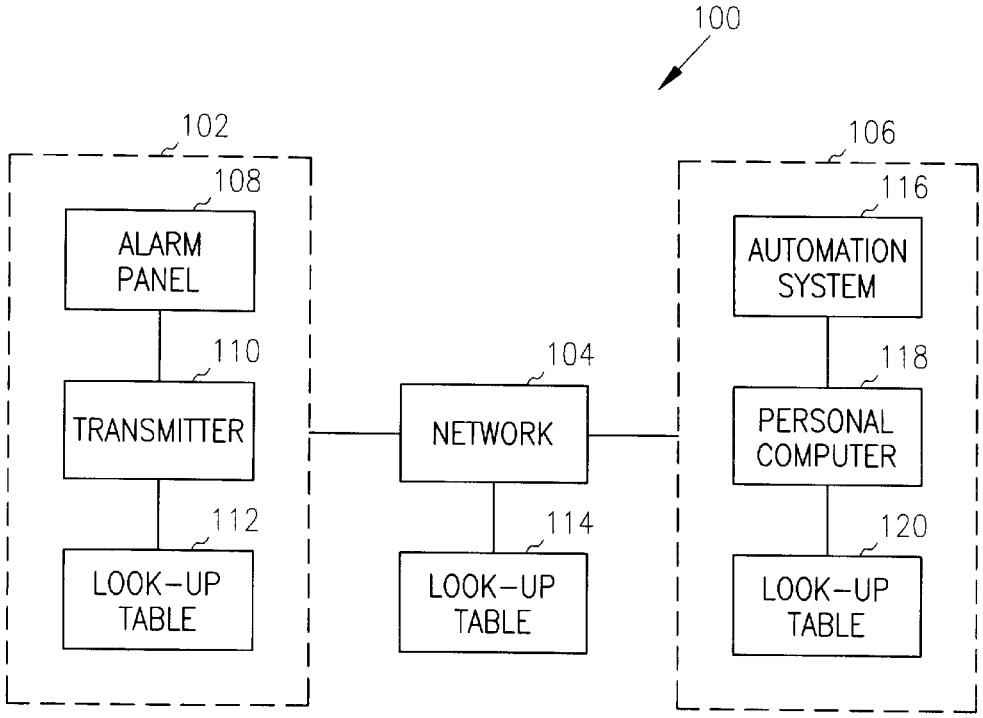
FIG. 1 is a block diagram illustrating a system in accordance with one embodiment.

In the following detailed description of the invention, reference is made to the accompanying drawings that form a part hereof, and in which are shown, by way of illustration, specific embodiments in which the invention may be practiced. In the drawings, like numerals describe substantially similar components throughout the several views. These embodiments are described in sufficient detail to enable those skilled in the art to practice the invention. Other embodiments may be utilized and structural, logical, and electrical changes may be made without departing from the scope of the present invention.

The embodiments herein describe the use of narrow-band personal communication system (NPCS) for the transmission of alarm signals. NPCS is a technology used for pagers, especially for two-way pagers. The described embodiments are compatible with both FLEX and ReFLEX protocols. The described embodiments use technologies that are cost effective—both hardware and transmission services—when compared with other large wireless networks. The described embodiments use interpretation tables to emulate standard industry formats for delivery of message to Central Station automation system.

Detection systems may continue to send long alarm messages via land-based modems. Wireless systems have been added to create an inexpensive redundancy in order to ensure that critical alarm messages get to the intended destination should land-based modems fail. Simplicity is important in these wireless systems. A message using numeric codes or textual language to send a message such as "Memorial Hospital, Fire, smoke detection device, device #39, north wing, fourth floor" might be shortened to a wireless message using three numeric codes meaning "Memorial Hospital, Fire, area 4". In one embodiment, if the land-based message were lost, a long wireless message would still allow the dispatching of a fire team. In another embodiment, if a detailed land-based message were lost, a shortened wireless message would still alert the fire team.

FIG. 1 is a block diagram illustrating a system in accordance with one embodiment. The system 100 includes a detection system 102. The detection system 102 includes an alarm panel 108. The alarm panel 108 generates an alarm signal when the detection system 102 detects an alarm event.

The detection system 102 includes a transmitter 110. The transmitter 110 is compatible with either FLEX or ReFLEX protocol. The transmitter 110 receives from the alarm panel 108 the alarm signal. Before transmitting the alarm signal, the transmitter 110 encodes the alarm signal into a message by using at least one look-up table 112. This translation of alarm signals within the detection 102 creates a universal interface for various alarm systems. The look-up table 112 encodes the alarm signal into a code. The code is one among a group of event types that can be encoded. Each event type signifies an alarm event, such as a fire or a burglary. The look-up table 112 also can optionally encode a destination string into the message. In one embodiment, the destination string includes a primary destination and a secondary destination, or additional destinations. The primary destination is the destination of choice for the message to be sent to. If the message cannot be sent to the primary destination, then the message will be sent to the secondary destination, or to the additional destinations. In another embodiment, the destination string can be used to store other information instead of or in addition to destination information.

After encoding, the transmitter 110 sends the message to a network 104. The network 104 is compatible with either FLEX or ReFLEX protocol. The network 104 decodes the message to obtain a destination address to send the rest of the message. To decode the message, the network 104 uses a look-up table 114. The look-up table 114 decodes just the destination portion of the message to obtain the destination to send the rest of the message.

The network 104 sends the message to a central station 106. The central station 106 includes a personal computer 118 . The personal computer 118 receives the message and decodes it. The personal computer 118 may use a look-up table 120 to decode the message. The look-up table 120 decodes the message and formats it into a security code. In one embodiment, such security code is compatible with industry standards, such as SIA, Ademco Contact ID, 4+2, etc. Once the security code is obtained, the personal computer passes the code on to the automation system 116 of the central station 106.

Figure 2:
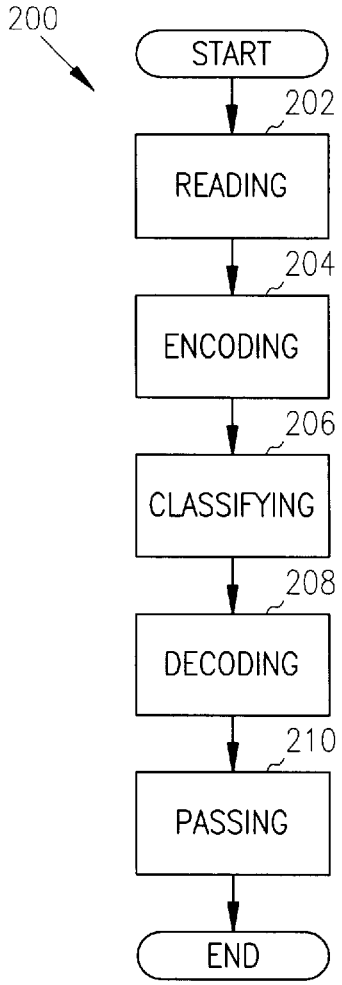
FIG. 2 is a process diagram illustrating a method in accordance with one embodiment.

FIG. 2 is a process diagram illustrating a method in accordance with one embodiment. The process 200 begins at block 202 by reading an alarm bus to detect at least one alarm signal. In one embodiment, a transmitter reads the alarm bus. Once an alarm signal is read, block 204 encodes the alarm signal into a message by using a look-up table. In one embodiment, the transmitter stores the look-up table. The message includes a code to determine an alarm event type from among a set of event types. The message also can optionally include a destination string so that a network may decode such destination string and determine where to send the message.

If there are multiple alarm signals on the bus, block 206 classifies among the multiple alarm signals and prioritizes them. The higher priority alarm signal will get encoded first.

Once a message appears on a network, the network may decode the message at block 208. The network may decode just the destination portion of the message to determine where to send the message. Once the network has determined the destination of the central station that is to receive the message, the network sends the message to that central station. The central station may decode the message again to obtain the security code. These decoding activities are accomplished through using at least one look-up table. Once the central station has decoded the security code, it passes the code to an automation system.

Figure 3:
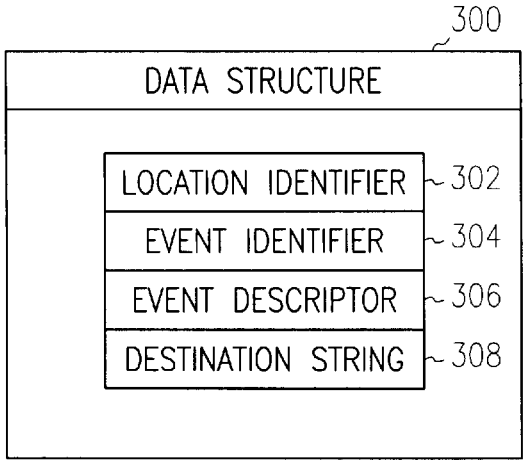
FIG. 3 is a structure diagram illustrating a data structure in accordance with one embodiment.

FIG. 3 is a structure diagram illustrating a data structure in accordance with one embodiment. The data structure 300 contains a message to be wirelessly transmitted using a narrow-band personal communication system. The data structure 300 can be formatted to be compatible with either FLEX or ReFLEX protocol. The data structure 300 includes a location identifier 302. The location identifier 302 identifies a location of interest that includes a premise such as a hospital or a residence. The location of interest is understood to mean the inclusion of the address of the premise where the alarm event has occurred. The event identifier 304 identifies the alarm event that gives rise to the alarm. The event descriptor 306 describes the alarm event in detail, such as the location on the premise where the fire is located. The destination string 308 identifies the destination of the central station that is to receive the message. The destination string 308 may contain at least one alternate central station if the message cannot be sent to the intended central station.

In the data structure 300, the destination string 308 and the location identifier 302 may be optionally included. The contents of the destination string 308 and the location identifier 302 may be transmitted separately, in one embodiment. In another embodiment, the contents of the destination string 308 and the location identifier 302 may be transmitted using existing transmission means of the FLEX or ReFLEX protocol. In another embodiment, the destination string 308 and the location identifier 302 can be used to send other information that is predetermined by the user or customer of the detection system.

FIG. 4 is a table illustrating a destination string in accordance with one embodiment. The table 400 discusses the possible configuration of the 11 bit Flex 25 destination format that can be used in the various embodiments described heretofore.

Table 400 illustrates the Destination Code. The message needs to have a destination so that the network knows where to pass it. One encoding example is the use of NPCS Flex 25 two-way pager wireless services. In Flex 25 an 11 bit string (an 11 bit string is eleven zeros or ones) is available for a burst transmission. This message is then split into registry sections for the purpose of sending a message. Table 400 also illustrates Back up and Alternative Code. These are important when sending critical messages like those used in the security industry to protect life and property.

For illustrative purposes only, a string may look like "001/0111/0101." The slashes indicate breaks in the register of the look up table and are not transmitted. This string can be interpreted to mean the following: send the message to Central Station A and send another message to Central Station B if Central Station A is not receiving.

The register size, order, and meaning of the 11 bit string can be changed to meet the needs of individual network designs. However, the purpose and use remains unchanged. Similar encoding registers can be used in any wireless transmission short bursting format.

An alarm message should contain premise or customer identification. When using NPCS (Narrowband PCS) as the wireless transmission method, pager capcodes (capcodes are the addresses used to identify individual addresses—there is a unique capcode for each pager or common pager address, and common addressing—pagers can hold more than one capcode for broadcast messaging) identify the individual user and the detection system that is transmitting the message. For example, capcode 978654903 may uniquely indicate Joe Smith's pager while another capcode may also reside on Joe Smith's pager for broadcast receipt of the news or weather. In one embodiment, the capcode is passed by the NPCS network and becomes a serial number or account number that acts as the premise or customer identification.

The message should also contain the type of signal and signal information. The alarm data is available to be read on the processing bus of the alarm panel. Most alarm panel manufacturers have an output port or could easily provide one. This could be an asynchronous port or an RS232 port or some other standard computer protocol port. The NPCS transmission device could apply the use of a matching input port or an adapter between ports. Alternatively, simple voltage triggers could be provided by alarm manufacturers to indicate conditions such as "fire" and "burglary".

In one embodiment, the NPCS transmitter may be able to read the activity of the alarm panel bus. When it detects various signal transmission types it may read them and translate them according to a look up table stored in the transmitter. The lookup table will be developed specifically for each alarm manufacturer. If multiple messages are read, the look up table establishes priority of messaging according to the order arrangement of the table.

This translation will take potentially long and complex messages and translate them in a common type of signal and signal information code. This creates a common "language" so that all of the various codes indicating "fire" on various manufacturers' systems are translated in a universal code for "fire" on the NPCS transmission network. This makes the use of a simple interface device possible at the central station, because the central station does not have to interpret messages from a large number of sources—only one message type is sent and received.

Message receipt and decoding at the central station can be accomplished by various embodiments. In one embodiment, the message is received at the central station through an interface to the NPCS network. This could be a wireless transceiver, a frame connection, standard modem, internet connection or other connection suitable to the data stream volume. In another embodiment, the message is received at the central station into a standard personal computer for preliminary processing. In another embodiment, the central station's look up table is employed to decode the message (The effect is that an encoded message that looks like "0010100" can be decoded and read out "Burglary Area 4" at the central station.) In one embodiment, as the message is decoded, it is translated into standard security industry formats such as SIA, Ademco Contact ID, 4+2 or other formats. This allows for an easy acceptance into the central station system through a standard device. In another embodiment, the message is passed from the personal computer into the automation system of the central station.

In another embodiment, the messaging may use standard acknowledgement response to be handled in the network. This is an ordinary computer messaging process that provides error checking and receipt acknowledgment between devices.

Figure 5:
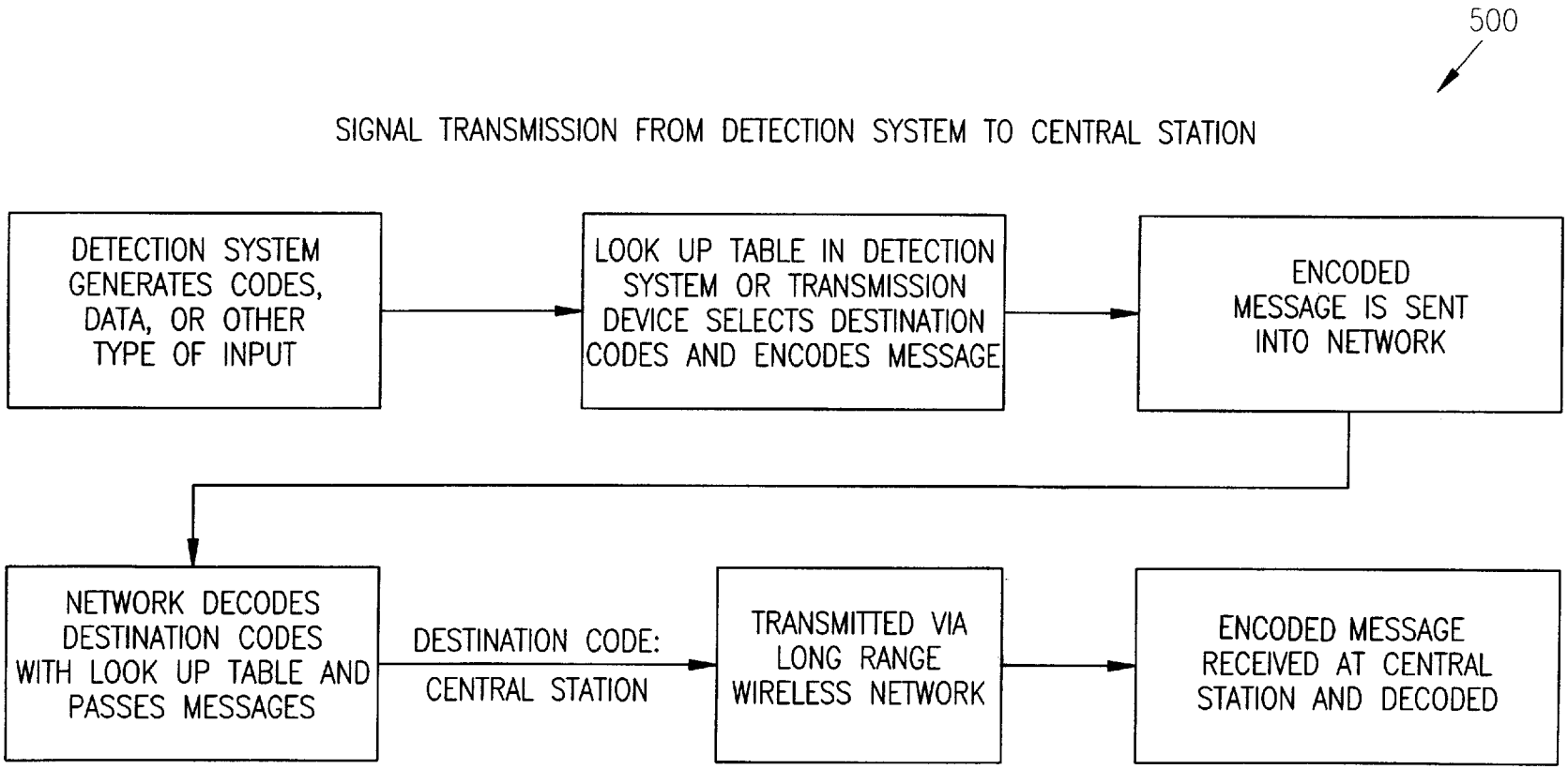
FIG. 5 is a process diagram illustrating a method in accordance with one embodiment.

FIG. 5 is a process diagram illustrating a method in accordance with one embodiment. The process 500 illustrates signal transmission of a detection signal from a detection system to a central station.

CONCLUSION

Thus, systems, structures, and methods have been described for enhancing wireless communication system used for detection purposes. The described invention has many benefits. It is based on low cost wireless technology. It can be easily and inexpensively connected to a detection system. It can be easily and inexpensively connected to a central station. The interface to connect the described invention is not complicated and can be developed by manufacturers of detection systems.

Because of its economy and ease of use, it is likely that the invention will enjoy broad adoption by the marketplace.

Although the specific embodiments have been illustrated and described herein, it will be appreciated by those of ordinary skill in the art that any arrangement which is calculated to achieve the same purpose may be substituted for the specific embodiment shown. This application is intended to cover any adaptations or variations of the present invention. It is to be understood that the above description is intended to be illustrative and not restrictive. Combinations of the above embodiments and other embodiments will be apparent to those of skill in the art upon reviewing the above description. The scope of the invention includes any other applications in which the above structures and fabrication methods are used. Accordingly, the scope of the invention should only be determined with reference to the appended claims, along with the full scope of equivalents to which such claims are entitled.

What is claimed is:

1. A system comprising:

a security alarm panel to provide an alarm signal; and a transmitter adapted for reception of the alarm signal, the transmitter transmitting a message after receipt of the alarm signal, the message generated in a short burst message format compatible with the ReFLEX protocol and using at least one look-up table, the at least one look-up table to encode the alarm signal of the security alarm panel as one of a plurality of event types into a wireless message, wherein the look-up table includes a code for each event type, and wherein the message includes a destination string.

2. The system of claim 1, further comprising:

a network to pass a portion of the wireless message; and a second look-up table accessible to the network, the second look-up table used to decode the destination string to determine a destination of the portion of the wireless message.

3. The system of claim 2, wherein the network is substantially compatible with ReFLEX protocol.

4. The system of claim 2, further comprising:

at least one central station adapted to receive the portion of the wireless message from the network; and a third look-up table accessible to each of the at least one central station and used to decode the portion of the wireless message and produce a security code.

5. The system of claim 4, wherein the at least one central station further comprises a computer.

6. A method comprising:

receiving at least one alarm signal from a security alarm bus, the at least one alarm signal received by a wireless transmitter; and encoding the at least one alarm signal into a wireless short burst message format compatible with the ReFLEX protocol and using at least one look up table, the wireless message including a code representing one of a plurality of event types, and further including a destination string.

7. The method of claim 6, wherein receiving at least one alarm signal comprises receiving a first alarm signal having a first priority and receiving a second alarm signal having a second priority, the method further comprising classifying priority of the at least one alarm signal and encoding the first alarm signal before encoding the second alarm signal.

8. The method of claim 6, further comprising decoding the wireless message to determine a destination for the wireless message based on the destination string.

9. The method of claim 6, further comprising decoding the wireless message into a security code.

10. The method of claim 9, further comprising passing the security code to an automation system of a central station.

11. A data structure for a message to be wirelessly transmitted using a communication system, the data structure comprising:

an event identifier to identify a security alarm event that generates an alarm; and an event descriptor to describe the security alarm event in at least one detail;

wherein the message is a wireless pager message in a short burst format compatible with the ReFLEX protocol.

12. The data structure of claim 11, further comprising a location identifier to identify a location of interest.

13. The data structure of claim 12, wherein the location identifier identifies a premise where the security alarm event has occurred.

14. The data structure of claim 11, wherein the event identifier identifies a burglary event.

15. The data structure of claim 11, wherein the event identifier identifies a fire event.

16. The data structure of claim 12, wherein the event descriptor describes an area within the location of interest.

17. A data structure for a security alarm message to be wirelessly transmitted using a communication system, the data structure comprising:

a destination string to identify a primary destination where the security alarm message is to be transmitted upon detection of a security alarm event using a security alarm system;

a location identifier to identify a location of interest based on the detected security alarm event;

an event identifier to identify the security alarm event at the location of interest; and an event descriptor to describe the security alarm event in at least one detail;

wherein the message is a pager message in a short burst format compatible with the ReFLEX protocol.

18. The data structure of claim 17, wherein the destination string identifies a secondary destination.

19. The data structure of claim 18, wherein the message is wireless transmitted to the secondary destination.

20. The data structure of claim 17, wherein the location identifier includes a capcode.

21. A method of communicating comprising:

receiving notification of a security event from an alarm panel;

encoding the security event into a short burst message, the short burst message including a code, the code selected as a function of the security event and the short burst message including a destination string, the destination string determined as a function of a destination; and transmitting the short burst message using a wireless two way pager network.

22. The method of claim 21 wherein the short burst message is compatible with ReFLEX protocol.

23. The method of claim 21 wherein the short burst message comprises an 11 bit string.

24. A method of communicating comprising:

receiving a short burst message formatted in a two way paging protocol at a central station, the short burst message corresponding to a security event, wherein the central station is adapted for monitoring security alarms, further wherein the short burst message includes a code representing the security event, the short burst message including a destination string corresponding to the central station;

decoding the code representing the security event; and generating a security code as a function of the code representing the security event.

25. The method of claim 24 wherein the short burst message is compatible with ReFLEX protocol.

26. The method of claim 24 wherein the short burst message comprises an 11 bit string.

* * * * *